US011513474B2

(12) United States Patent
Hosobuchi

(10) Patent No.: US 11,513,474 B2
(45) Date of Patent: Nov. 29, 2022

(54) SWITCH DEVICE AND TIMEPIECE

(71) Applicant: CASIO COMPUTER CO., LTD., Tokyo (JP)

(72) Inventor: Hiroyuki Hosobuchi, Iruma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/226,249

(22) Filed: Apr. 9, 2021

(65) Prior Publication Data

US 2021/0333757 A1 Oct. 28, 2021

(30) Foreign Application Priority Data

Apr. 24, 2020 (JP) ..... JP2020-077528

(51) Int. Cl.
*G04B 3/04* (2006.01)
*G04B 3/00* (2006.01)
*G04B 37/00* (2006.01)

(52) U.S. Cl.
CPC ..... *G04B 3/041* (2013.01); *G04B 3/003* (2013.01); *G04B 37/0008* (2013.01)

(58) Field of Classification Search
CPC ..... G04C 3/005; G04C 3/002; G04C 3/007; G04B 3/041; G04B 3/003; G04B 3/007; G04B 37/0008; G04B 13/028; G04B 19/225; G04B 27/002; G04B 3/043; G04B 37/10; G04B 37/103
See application file for complete search history.

(56) References Cited

U.S. PATENT DOCUMENTS 7,401,975 B2 7/2008 Hiranuma et al.
7,517,139 B2 * 4/2009 Hiranuma ..... G04B 37/10 368/308

(Continued)

FOREIGN PATENT DOCUMENTS

JP H07-270547 A 10/1995
JP 2003-130965 A 5/2003

(Continued)

OTHER PUBLICATIONS

Notice of Reasons for Refusal dated Feb. 25, 2022 received in Japanese Patent Application No. JP 220-077528 together with an English language translation.

(Continued)

*Primary Examiner* — Edwin A. Leon
(74) *Attorney, Agent, or Firm* — Scully Scott Murphy & Presser

(57) ABSTRACT

A switch device including a base member provided with a stem insertion hole, an operation member which has an engaging groove provided in an outer circumferential surface thereof, and is slidably and rotatably inserted into the stem insertion hole of the base member, a stopper member having an engaging portion which is arranged in the engaging groove of the operation member and moved along with sliding of the operation member, and a release member which releases the engaging portion from the engaging groove, in which the release member includes a pressing portion which is operated from one surface side of the base member so as to release the engaging portion from the engaging groove.

17 Claims, 10 Drawing Sheets

(56) References Cited

U.S. PATENT DOCUMENTS

| | | | | |
|---|---|---|---|---|
| 7,942,574 | B2 * | 5/2011 | Hozumi | G04B 3/043 368/308 |
| 8,721,171 | B2 * | 5/2014 | Tsuji | G04B 37/081 368/319 |
| 8,971,156 | B2 * | 3/2015 | El Kadiri | G04B 3/043 368/308 |
| 2005/0207286 | A1 | 9/2005 | Hiranuma et al. | |

FOREIGN PATENT DOCUMENTS

| | | | |
|---|---|---|---|
| JP | 2005-274362 | A | 10/2005 |
| JP | 2006-010574 | A | 1/2006 |
| JP | 5467511 | B2 | 4/2014 |
| JP | 2015-158503 | A | 9/2015 |
| JP | 2017-142155 | A | 8/2017 |
| JP | 2017-161283 | A | 9/2017 |

OTHER PUBLICATIONS

Extended European Search Report dated Aug. 31, 2021 received in European Patent Application No. EP 21169551.5.

* cited by examiner

SWITCH DEVICE AND TIMEPIECE

CROSS-REFERENCE TO RELATED APPLICATION

This application is based upon and claims the benefit of priority from the prior Japanese Patent Application No. 2020-077528, filed Apr. 24, 2020, the entire contents of which are incorporated herein by reference.

BACKGROUND

1. Technical Field

The technical field relates to a switch device that is used for electronic devices such as timepieces, and a timepiece equipped with the switch device.

2. Description of the Related Art

A switch device for timepieces is known which has a structure where an operation member called a winding stem is slidably and rotatably inserted into a stem insertion hole of a base member, an engaging section of a stopper member called a setting lever is arranged in an engaging groove of the operation member, and a rotation restriction section restricts the rotation of the stopper member caused by the movement of the engaging section when the stopper member is rotated along with the movement of the engaging section made in response to the sliding of the operation member, whereby the sliding position of the operation member is restricted, as described in Japanese Patent Application Laid-Open (Kokai) Publication No. 2006-010574.

SUMMARY

In accordance with one embodiment, there is provided a switch device comprising: a base member provided with a stem insertion hole; an operation member which has an engaging groove provided in an outer circumferential surface thereof, and is slidably and rotatably inserted into the stem insertion hole of the base member; a stopper member having an engaging portion which is arranged in the engaging groove of the operation member and moved along with sliding of the operation member; and a release member which releases the engaging portion from the engaging groove, wherein the release member includes a pressing portion which is operated from one surface side of the base member so as to release the engaging portion from the engaging groove.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment applied in a wristwatch will hereinafter be described with reference to FIG. 1 to FIG. 10.

Figure 1:
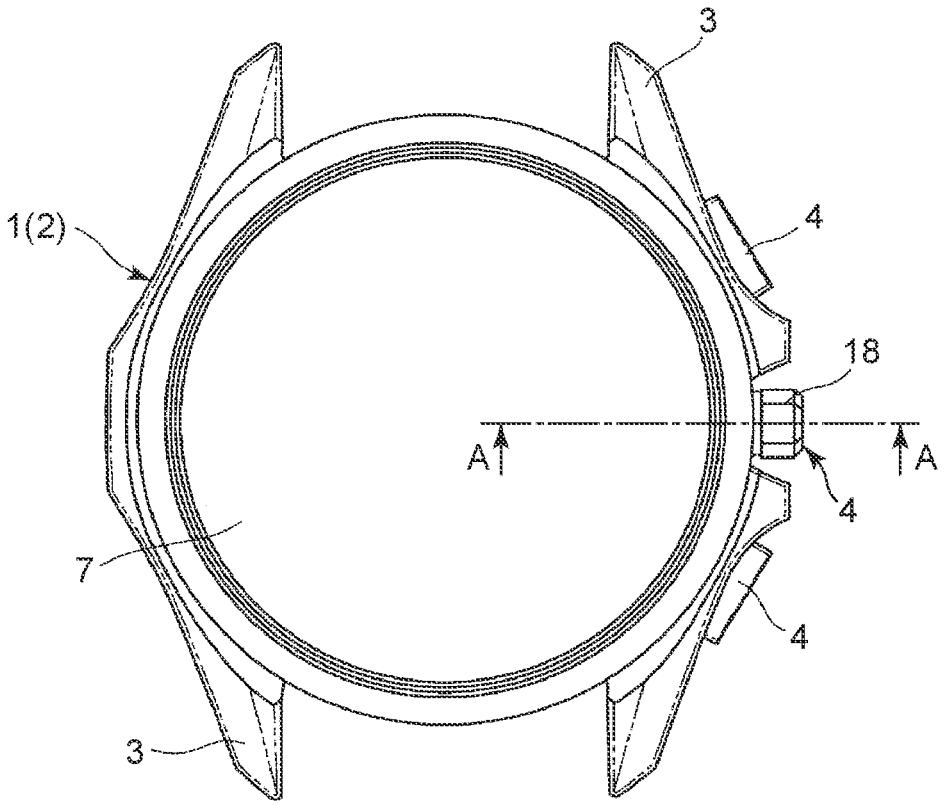
FIG. 1 is an enlarged front view showing an embodiment of a wristwatch.
Figure 2:
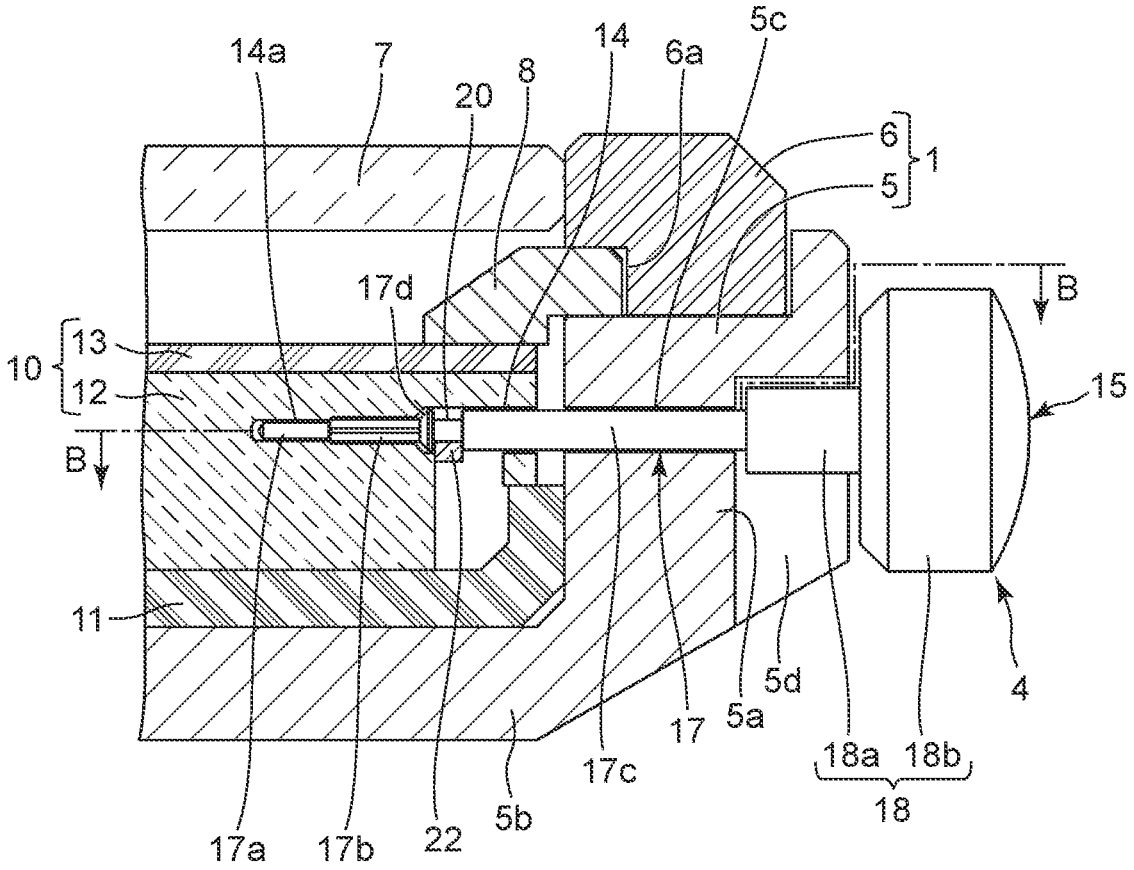
FIG. 2 is an enlarged cross-sectional view showing a main portion of a first wristwatch case of the wristwatch taken along the A-A arrow view shown in FIG. 1.
Figure 7:
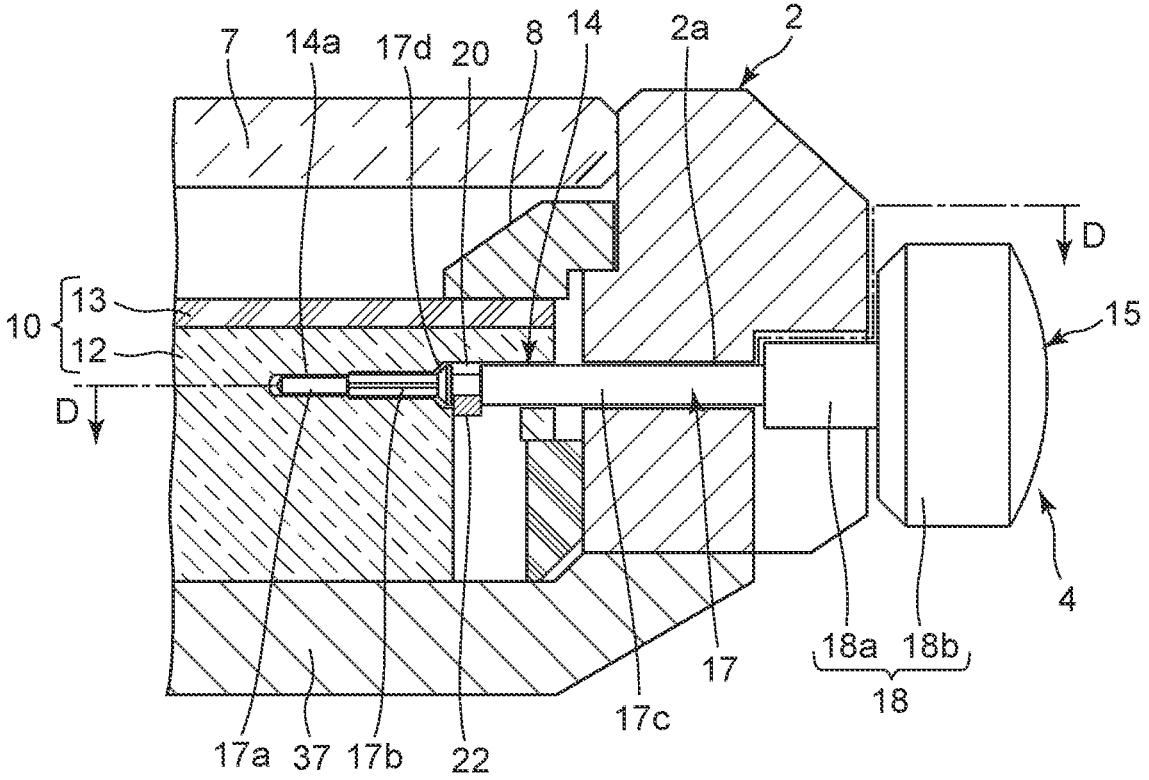
FIG. 7 is an enlarged cross-sectional view showing a main portion of a second wristwatch case of the wristwatch taken along the A-A arrow view shown in FIG. 1.

This wristwatch has a first wristwatch case 1 shown in FIG. 1 and FIG. 2 and a second wristwatch case 2 shown in FIG. 1 and FIG. 7, which are different types of wristwatch cases and alternatively used.

On outer circumferential portions of the first and second wristwatch cases 1 and 2 on the twelve o'clock side and the six o'clock side, band attachment sections 3 where a watch band (not shown) is attached are provided, as shown in FIG. 1. Also, on outer circumferential portions of these first and second wristwatch cases 1 and 2 on the two o'clock side, the three o'clock side, and the four o'clock side, switch devices 4 are provided.

The first wristwatch case 1 includes a main body case 5 which is a first case, and an upper case 6 which is a second case, as shown in FIG. 2. The main body case 5 includes a cylindrical section 5*a* having a substantially cylindrical shape and a bottom section 5*b* integrally formed on the lower part of the cylindrical section 5*a*. The upper case 6 is formed in a substantially ring shape and structured to be arranged on the upper end of the main body case 5, that is, the upper end of the cylindrical section 5*a* and attached thereto with screws.

In an opening portion on the front surface side of the first wristwatch case 1, that is, on inner portions of the upper case 6, a watch glass 7 and a parting member 8 are provided, as shown in FIG. 1 and FIG. 2. The watch glass 7 is fitted into the upper inner part of the upper case 6. The parting member 8 is formed in a ring shape and attached under the watch glass 7 such that its outer circumferential portion is arranged in a first cutout recess section 6*a* provided in the lower part of the inner circumferential surface of the upper case 6 and its inner circumferential portion projects into the inside of the upper case 6.

Inside the first wristwatch case 1, or more specifically, inside the main body case 5, a timepiece module 10 is housed via a middle frame 11, as shown in FIG. 2. This timepiece module 10 includes a housing 12 which is a base member and a dial plate 13 provided on the upper surface of the housing 12. Although not shown in the drawing, this housing 12 has various built-in components necessary for timepiece functions, such as a timepiece movement for driving pointers above the dial plate so as to indicate the time, a display section for electrooptically displaying information including time information, and a circuit section for electrically controlling and driving them.

Figure 3:
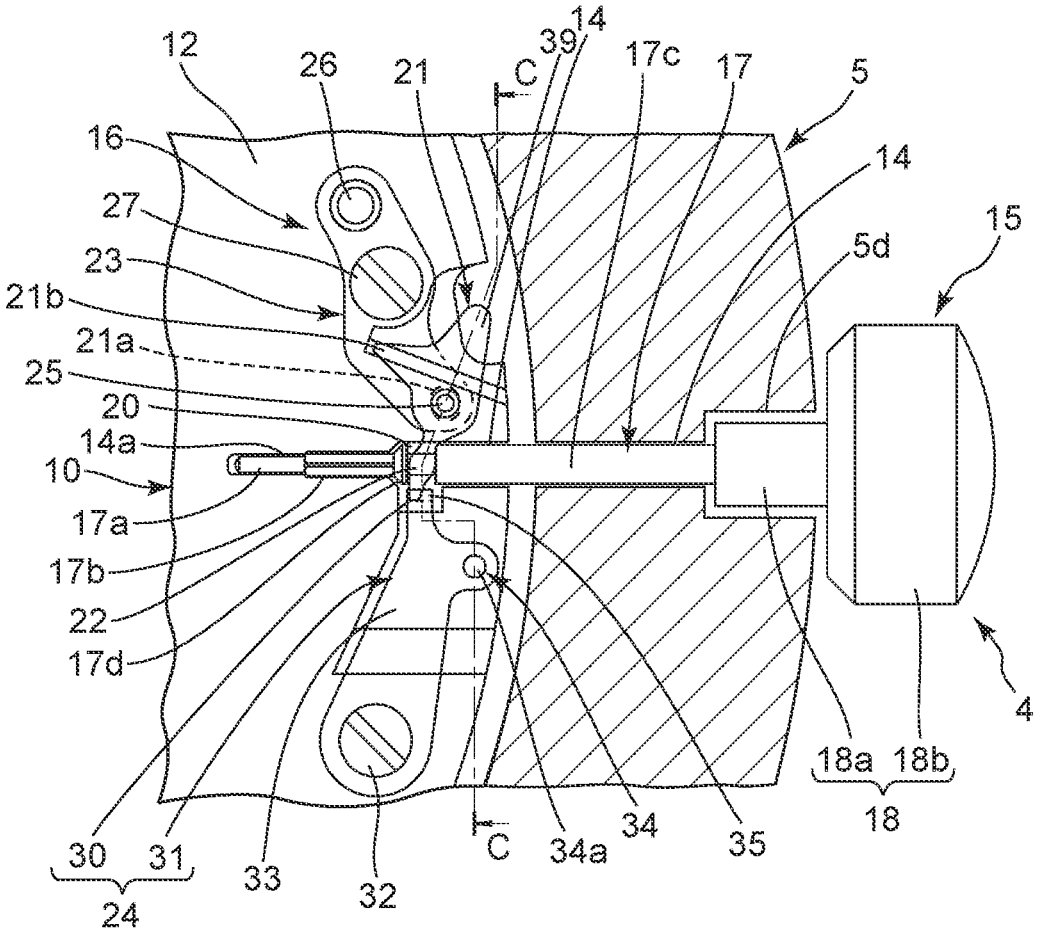
FIG. 3 is an enlarged planar view of the main portion of the first wristwatch case taken along the B-B arrow view in FIG. 2, in which a corresponding relation between a stopper member and a release lever with respect to an operation member is shown.

Among the plurality of switch devices 4 described above, the switch device 4 on the three o'clock side includes an operation member 15 slidably and rotatably inserted into a stem insertion hole 14 of the housing 12 through a through hole 5*c* provided in the cylindrical section 5*a* of the main body case 5 of the first wristwatch case 1, and a slide restriction mechanism 16 for restricting the slide position of the operation member 15, as shown in FIG. 2 and FIG. 3. Here, the stem insertion hole 14 of the housing 12 is provided on a straight line connecting the three o'clock point of the main body case 5 and the center thereof.

The operation member 15 includes a cylindrical shaft section 17 called a winding stem and a winder 18, as shown in FIG. 2 and FIG. 3. The shaft section 17 includes a guide section 17*a*, a spline section 17*b*, and a shaft main body 17*c* in the order from its inner end side. The guide section 17*a* is a small diameter portion formed in a round stick shape, and its length in the axial direction is slightly longer than the slide length of the operation member 15.

Also, the guide section 17*a* is slidably and rotatably inserted into a small diameter hole 14*a* which is located at the inner end of the stem insertion hole 14 of the housing 12 and the cross-sectional shape of which is circular, as shown in FIG. 2 and FIG. 3. This guide section 17*a* is structured not to slip out of the small diameter hole 14*a* even when the operation member 15 is slid in the direction to be pulled out.

The spline section 17*b* is a non-circular portion whose diameter is greater than that of the guide section 17*a* and cross-sectional shape is non-circular and polygonal such as quadrilateral, and its length in the axial direction is formed longer than the slide length of the operation member 15 as in the case of the guide section 17*a*, as shown in FIG. 2 and FIG. 3. Although not shown in the drawing, this spline section 17*b* is structured such that a cam cylinder is slidably attached thereto which causes a plurality of switch plates to perform switch operations.

Although not shown in the drawing, this cam cylinder is formed in a substantially cylindrical shape such that a plurality of cam sections is provided in its outer circumferential surface and positioned side by side in the axial direction, and causes the plurality of switch plates to perform switch operations. Also, this cam cylinder has a non-circular cross-sectional shape as with the spline section 17*b*, and is rotatably arranged in a predetermined area of the housing 12. That is, this cam cylinder is structured to be rotated along with the rotation of the operation member 15 and not to be moved even when the operation member 15 is slid.

The shaft main body 17*c* is formed in a round stick shape whose diameter is greater than that of the spline section 17*b* and cross-sectional shape is circular, as shown in FIG. 2 and FIG. 3. This shaft main body 17*c* is formed such that its length in the axial direction is equal to or longer than the thickness of the cylindrical section 5*a* of the main body case 5 of the first wristwatch case 1. That is, the shaft main body 17*c* is structured such that its outer end portion protrudes into a second cutout section 5*d* in an outer circumferential portion of the main body case 5 through the through hole 5*c* of the main body case 5 with its inner end side being in the stem insertion hole 14 of the housing 12, and the winder 18 is attached to this protruding outer end portion.

On the inner end side of this shaft main body 17*c*, or in other words, in its portion near the spline section 17*b*, an engaging groove 20 is annularly provided in the circumferential direction, as shown in FIG. 2 and FIG. 3. This engaging groove 20 is formed such that its inner diameter is substantially equal to the outer diameter of the spline section 17*b* and its length in the axial direction is substantially equal to the outer diameter of the shaft main body 17*c*. On an end portion of the shaft main body 17*c* on the inner end side of the engaging groove 20, an inclined guide section 17*d* is provided.

The winder 18 is an operation section for the operation member 15, and includes an attachment section 18*a* and a head section 18*b*, as shown in FIG. 2 and FIG. 3. The attachment section 18*a* is formed such that its outer diameter is greater than that of the shaft main body 17*c* of the shaft section 17 and its length in the axial direction is substantially equal to that of the second cutout section 5*d* provided in the outer circumferential portion of the main body case 5. That is, the attachment section 18*a* is structured to be attached to the outer end of the shaft main body 17*c* protruding into the second cutout section 5*d* of the main body case 5 and thereby arranged in the second cutout section 5*d*.

Figure 4:
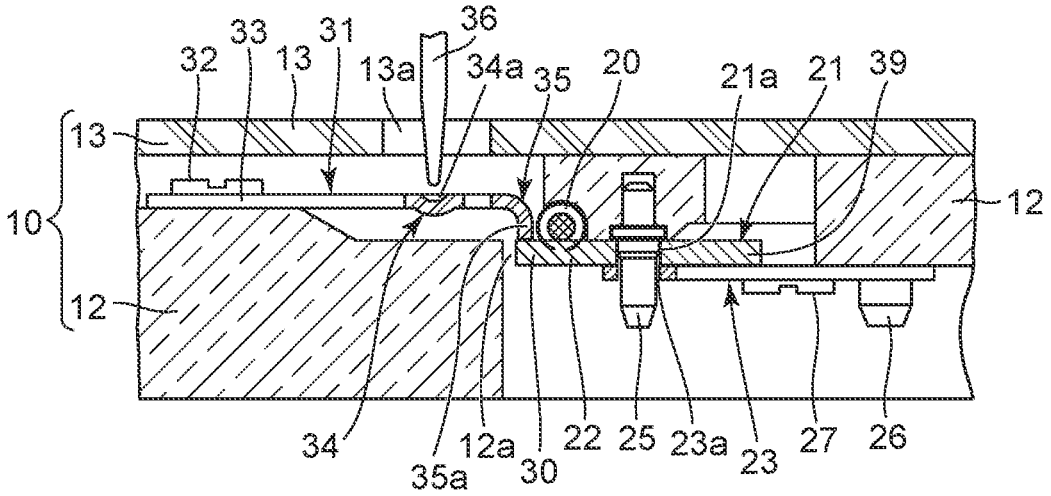
FIG. 4 is an enlarged cross-sectional view showing a main portion of a switch device taken along the C-C arrow view shown in FIG. 3.

The head section 18*b* is integrally provided on the outer end of the attachment section 18*a*, as shown in FIG. 2 to FIG. 4. This head section 18*b* is formed such that its outer diameter is sufficiently greater than that of the attachment section 18*a* and substantially half of the thickness of the first wristwatch case 1, and its length in the axial direction is shorter than the thickness of the cylindrical section 5*a* of the main body case 5 and longer than the length of the attachment section 18*a* in the axial direction. As a result, the operation member 15 is structured such that the shaft section 17 is rotated along with the rotation of the winder 18, and is slid along with a pulling operation on the winder 18.

Figure 5:
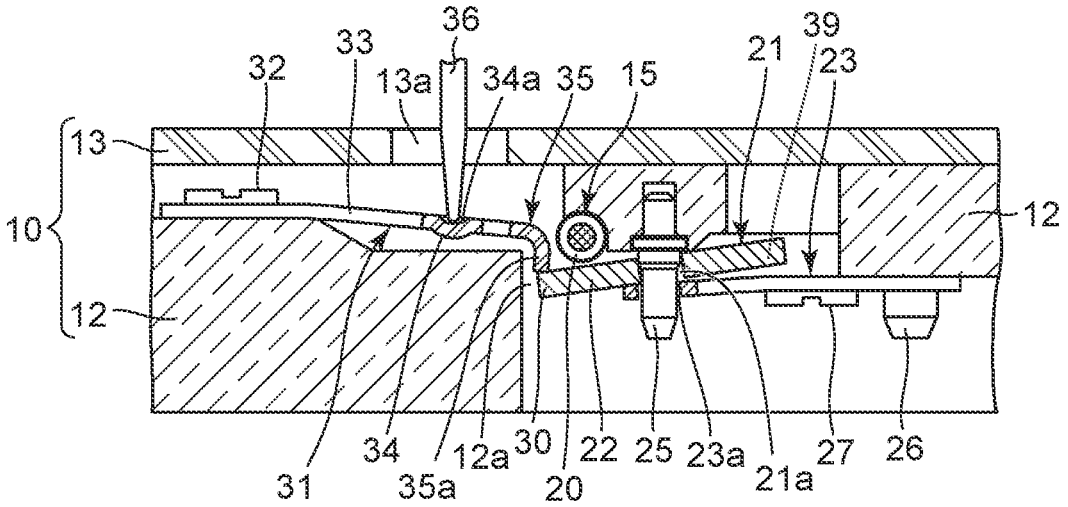
FIG. 5 is an enlarged cross-sectional view of the main portion of the switch device shown in FIG. 4, in which the stopper member engaged with the operation member has been released therefrom by the release lever.

On the other hand, the slide restriction mechanism 16 includes a stopper member 21 called a setting lever which is provided with an engaging section 22 that is arranged in the engaging groove 20 of the operation member 15, a hold-down plate 23 which holds down the stopper member 21 in order to maintain a state where the engaging section 22 of the stopper member 21 is in the engaging groove 20 of the operation member 15, a release member 24 which releases the engaging section 22 of the stopper member 21 from the engaging groove 20 of the operation member 15, and a position regulation member (not shown) which regulates the rotation position of the stopper member 21, as shown in FIG. 3 to FIG. 5.

The stopper member 21 has a plate shape and is provided on a portion of the back surface of the housing 12, that is, a portion of the lower surface of the housing 12, as shown in FIG. 3 to FIG. 5. More specifically, the stopper member 21 is rotatably attached to the fixing shaft 25 provided on the lower surface of the housing 12. In the stopper member 21, a shaft hole 21*a* is formed in a long hole shape that is slightly longer than the outer diameter of the fixing shaft 25 in a direction perpendicular to the axial direction of the operation member 15. As a result, the stopper member 21 is structured to be tilted with the fixing shaft 25 as a fulcrum.

On the stopper member 21, the engaging section 22 is provided projecting toward the operation member 15 from an outer peripheral portion that comes close to the shaft section 17 of the operation member 15, as shown in FIG. 3. This engaging section 22 is structured to be arranged crossing the engaging groove 20 of the operation member 15 and protrude toward the side opposite to the fixing shaft 25 of the stopper member 21.

As a result, the stopper member 21 is structured to be rotated around the fixing shaft 25 along with the movement of the engaging section 22 when the engaging section 22 is moved along with the slide of the operation member 15, as shown in FIG. 3. Also, on the stopper member 21, a projection section 39 is provided projecting from its outer peripheral portion toward the side opposite to the engaging section 22.

The engaging section 22 is formed in an elongated rhombus shape and arranged crossing the engaging groove 20 of the operation member 15 in the direction perpendicular to the axial direction of the operation member 15, as shown in FIG. 3. This engaging section 22 is structured to be moved along with the movement of the operation member 15 with side portions of the engaging section 22 being continuously in contact with inner side surfaces of the engaging groove 20 when the operation member 15 is slid.

On the other hand, the hold-down plate 23 has a plate spring shape and holds down the stopper member 21 on the lower surface of the housing 12, as shown in FIG. 3 to FIG. 5. This hold-down plate 23 is attached to a portion of the lower surface of the housing 12 with a first screw member 27 while being positionally restricted by a position restriction pin 26 provided on the lower surface of the housing 12. In a portion of the hold-down plate 23 extending to a base portion of the engaging section 22 of the stopper member 21, an insertion hole 23*a* is provided into which the fixing shaft 25 is inserted.

As a result, the hold-down plate 23 is structured to be attached to the lower surface of the housing 12 by the first screw member 27 while being positionally restricted by the position restriction pin 26 with the fixing shaft 25 being inserted into the insertion hole 23*a*, and thereby holds down the stopper member 21 on the lower surface of the housing 12 so as to hold down the engaging section 22 of the stopper member 21 on the inside of the engaging groove 20 of the operation member 15, as shown in FIG. 3 and FIG. 4.

The release member 24 includes a projection section 30 serving as a first pressing section (pressing portion) which is provided on the engaging section 22 and operated from the lower surface side of the housing 12, or in other words, the back surface side of the housing 12 so as to release the engaging section 22 of the stopper member 21 from the engaging groove 20 of the operation member 15, and a release lever 31 serving as a second pressing section (pressing portion) which is provided in the timepiece module 10 and operated from the upper surface side of the housing 12, or in other words, the front surface side of the housing 12 so as to release the engaging section 22 from the engaging groove 20, as shown in FIG. 3 to FIG. 5.

The projection section 30 of the engaging section 22, which is the first pressing section, is provided on the leading end of the engaging section 22 arranged projecting toward the operation member 15 from the outer periphery of the stopper member 21 and crossing the engaging groove 20 of the operation member 15, and protrudes toward the side opposite to the fixing shaft 25 of the stopper member 21, as shown in FIG. 3 to FIG. 5. When pressed against the hold-down force of the hold-down plate 23 and moved downward relative to the housing 12, this projection section 30 tilts the stopper member 21 with the fixing shaft 25 as a fulcrum, and thereby releases the engaging section 22 of the stopper member 21 from the engaging groove 20 of the operation member 15.

The release lever 31, which is the second pressing section, is arranged on a portion of the upper surface of the housing 12 and its one end portion is attached thereto with a second screw member 32, as shown in FIG. 3 to FIG. 5. This release lever 31 includes a lever main body 33 having an elongated plate shape, a pressing operation section 34 on which a pressing operation is performed from the upper surface side of the housing 12, and a release section 35 which presses down the projection section 30 of the engaging section 22 in response to a pressing operation performed on the pressing operation section 34 and thereby releases the engaging section 22 from the engaging groove 20 of the operation member 15.

The lever main body 33 is a plate spring and is structured to be flexurally and vertically deformed with the above-described portion attached to the upper surface of the housing 12 by the second screw member 32 as a fulcrum, as shown in FIG. 3 to FIG. 5. The pressing operation section 34 is provided projecting from a side edge portion of the lever main body 33 toward an outer circumferential portion of the housing 12 near the operation member 15. In a central portion of this pressing operation section 34, a concave section 34*a* is provided into which the leading end of a first tool 36 such as a pin component is inserted to be positionally restricted.

This pressing operation section 34 is arranged in an outer circumferential portion of the housing 12 near the operation member 15 and exposed on the upper surface side of the housing 12, as shown in FIG. 3. In this embodiment, in the dial plate 13 arranged on the upper surface of housing 12, an opening section 13*a* for upwardly exposing the pressing operation section 34 is provided corresponding to a portion of the parting member 8.

The release section 35 extends toward the projection section 30 on the leading end of the engaging section 22 of the stopper member 21 from the leading end of the release lever 31, that is, the leading end of the lever main body 33 which approaches the shaft section 17 of the operation member 15, as shown in FIG. 3 to FIG. 5. On the leading end of this extending release section 35, a contact section 35*a* is provided to be bent toward the projection section 30. This release section 35 is structured such that the contact section 35*a* bent toward the projection section 30 comes in contact with the projection section 30 from above through an opening 12*a* in the housing 12.

Figure 6:
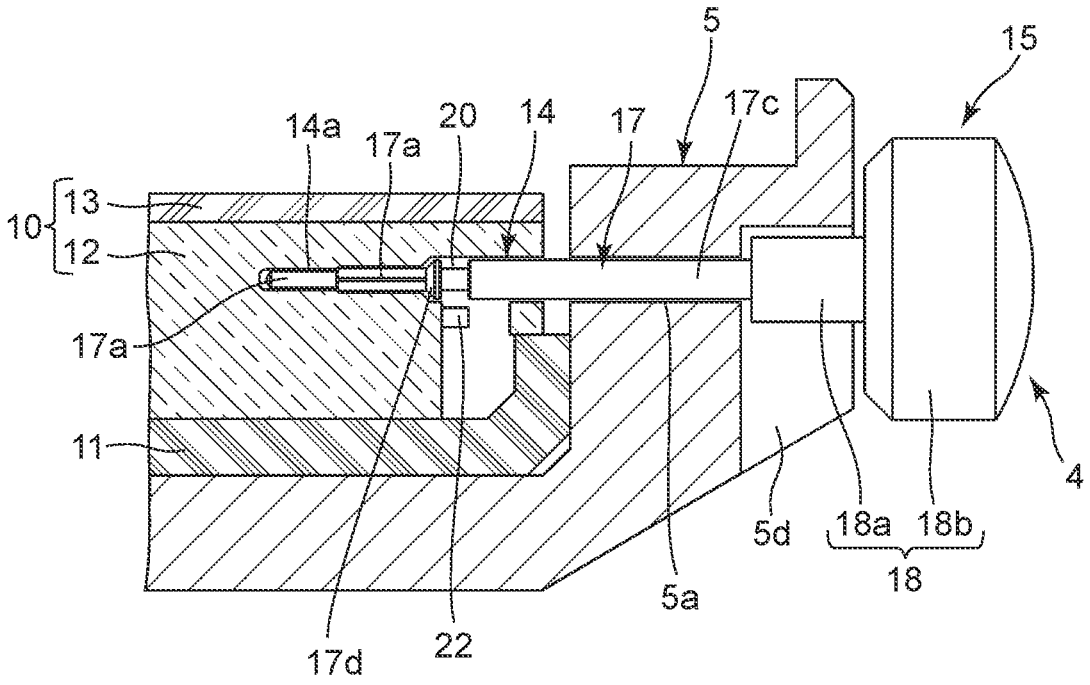
FIG. 6 is an enlarged cross-sectional view of the main portion of the switch device shown in FIG. 2, in which the stopper member engaged with the operation member has been released therefrom.

As a result, the release lever 31 is structured such that, when the upper case 6 is detached from the main body case 5 as shown in FIG. 6, the dial plate 13 provided on the upper surface of the housing 12 is exposed upward, and the pressing operation section 34 is exposed upward through the opening section 13*a* of the dial plate 13, as shown in FIG. 3 to FIG. 5.

Accordingly, the release lever 31 is structured such that the pressing operation section 34 is pressed from above the housing 12 by the first tool 36 such as a pin component inserted through the opening section 13*a* of the dial plate 13, as shown in FIG. 3 to FIG. 5. Consequently, the release lever 31 is structured such that, when the pressing operation section 34 is pressed from above the housing 12, the lever main body 33 is flexurally deformed and the release section 35 is pressed downward.

In addition, the release lever 31 is structured such that, when the release section 35 is pressed downward, the contact section 35*a* of the release section 35 presses down the projection section 30 provided on the leading end of the engaging section 22 of the stopper member 21 through the opening 12*a* in the housing 12, as shown in FIG. 3 to FIG. 5. Moreover, the release lever 31 is structured such that, when the contact section 35*a* of the release section 35 presses down the projection section 30, the stopper member 21 is tilted with the fixing shaft 25 as a fulcrum and thereby releases the engaging section 22 from the engaging groove 20 of the operation member 15.

The rotation position of the stopper member 21 is restricted by a position restriction member (not shown). Although not shown in the drawings, this position restriction member is a plate spring that is flexurally deformed in a direction to come in contact with the outer peripheral edge of the stopper member 21 or a direction to be away therefrom. In this position regulation member, a plurality of restriction recess sections is provided which releasably catches a restriction projection 21*b* of the stopper member 21.

As a result, the stopper member 21 is structured such that, when the operation member 15 is pressed toward the inside of the first wristwatch case 1, the restriction projection 21*b* of the stopper member 21 is caught by one of the plurality of restriction recess sections of the position restriction member, whereby the rotation position of the stopper member 21 is restricted and the position of the operation member 15 is restricted to a first slide position, as shown in FIG. 3.

Also, the stopper member 21 is structured such that, when the operation member 15 is pulled toward the outside of the first wristwatch case 1 in the state shown in FIG. 3, the engaging section 22 engaging with the engaging groove 20 of the operation member 15 is moved along with the slide of the operation member 15, the stopper member 21 is rotated around the fixing shaft 25 in the counterclockwise direction, and the restriction projection 21*b* caught in one of the restriction recess sections of the position restriction member is released therefrom and caught in another restriction recess section, whereby the rotation position of the stopper member 21 is restricted and the position of the operation member 15 is restricted to a second slide position.

On the other hand, the second wristwatch case 2, which is a different type of wristwatch case, is structured such that the watch glass 7 is fitted into the upper opening on the front surface side, the parting member 8 is arranged under the watch glass 7, and a back cover 37 is attached to the lower part of the second wristwatch case 2 on the back surface side, as shown in FIG. 1 and FIG. 7. In this second wristwatch case 2, the timepiece module 10 is mounted which is substantially the same as that in the first wristwatch case 1.

Figure 8:
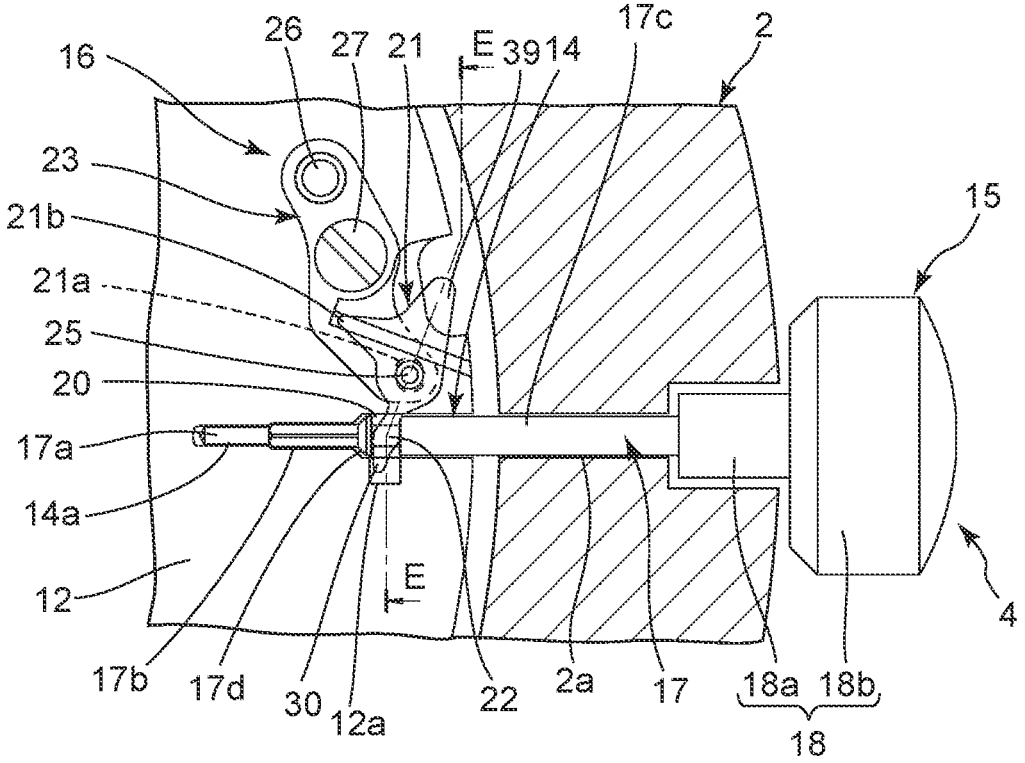
FIG. 8 is an enlarged planar view of the main portion of the second wristwatch case taken along the D-D arrow view in FIG. 7, in which a corresponding relation of the stopper member with respect to the operation member is shown.

In the case of this second wristwatch case 2, among the plurality of switch devices 4 provided on the two o'clock side, three o'clock side, and four o'clock side of the second wristwatch case 2, the switch device 4 on the three o'clock side is structured such that the shaft section 17 of the operation member 15 is inserted into the stem insertion hole 14 in the housing 12 of the timepiece module 10 in the second wristwatch case 2 through a through hole 2*a* of the second wristwatch case 2, as shown in FIG. 7 and FIG. 8.

Also, this switch device 4 in the second wristwatch case 2 is structured such that, when the back cover 37 is detached from the lower part of the second wristwatch case 2, the projection section 30 which is the first pressing section provided on the leading end of the engaging section 22 of the stopper member 21 is exposed on the lower side of the second wristwatch case 2, as shown in FIG. 7 to FIG. 10. In this case where the second wristwatch case 2 is used, the release lever 31 which is the second pressing section is not provided.

As a result, this switch device 4 is structured such that, when the operation member 15 thereof is to be detached from the second wristwatch case 2, the back cover 37 is detached, a second tool 38 such as an L-shaped member is hooked on the projection section 30 of the engaging section 22 downwardly exposed, and the projection section 30 is pulled downward by the second tool 38, as shown in FIG. 7 to FIG. 10. That is, this switch device 4 is structured such that the second tool 38 is inserted into the opening 12*a* of the housing 12 from below, and hooked on the projection section 30 of the engaging section 22.

Figure 10:
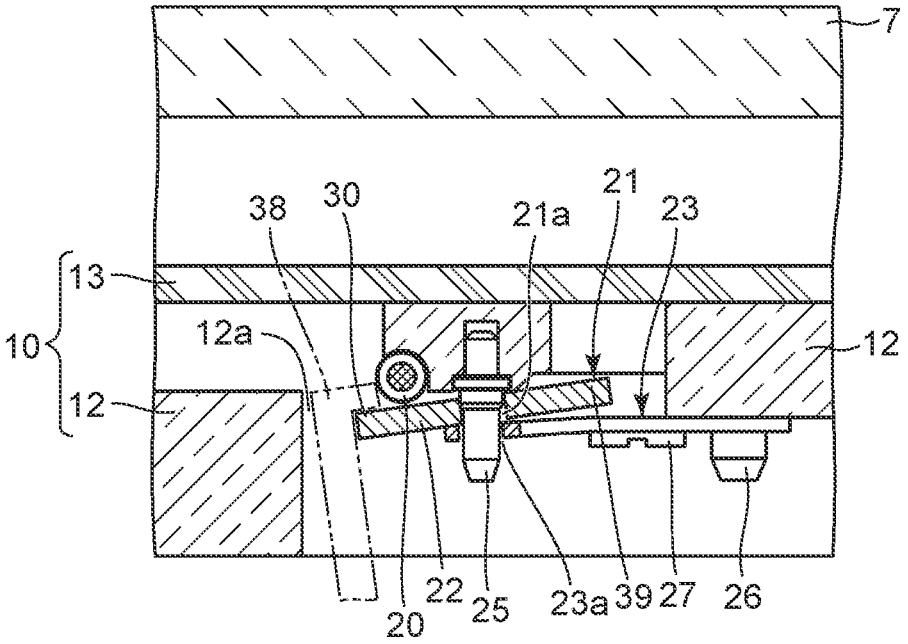
FIG. 10 is an enlarged cross-sectional view of the main portion of the switch device shown in FIG. 9, in which the stopper member engaged with the operation member has been released therefrom.

Consequently, this switch device 4 is structured such that, when the projection section 30 is pulled downward by the second tool 38, the stopper member 21 is tilted with the fixing shaft as a fulcrum, whereby the engaging section 22 can be released from the engaging groove 20 of the operation member 15 and the shaft section 17 of the operation member 15 with the winder 18 can be pulled out of the second wristwatch case 2 without the release lever 31, as shown in FIG. 10.

Next, the mechanism of the switch device 4 in the above-described wristwatch is described.

First, the assembly of this wristwatch having the first wristwatch case 1 is described. In this assembly, first, the timepiece module 10 is housed from above into the main body case 5 such that the stem insertion hole 14 of the housing 12 is coaxially positioned with the through hole 5*c* of the main body case 5. In this state, the shaft section 17 of the operation member 15 is inserted into the through hole 5*c* of the main body case 5 from outside the first wristwatch case 1, and then further inserted into the stem insertion hole 14 of the housing 12.

Here, the engaging section 22 of the stopper member 21 has been arranged in the stem insertion hole 14. However, by the inclined guide section 17*d* being provided on the inner end of the shaft main body 17*c* of the shaft section 17, the engaging section 22 is pressed downward along the inclination of the inclined guide section 17*d*. This engaging section 22 surmounts the inclined guide section 17*d* and engages with the engaging groove 20 of shaft main body 17*c*.

As a result, when the stopper member 21 is rotated along with a pulling operation performed on the operation member 15, the position of the restriction projection 21*b* of the stopper member 21 is restricted by the position restriction member (not shown), whereby the rotation of the stopper member 21 is restricted and the slide position of the operation member 15 is restricted. In this state, when the upper case 6 is attached to the main body case 5 with screws, the assembly of the wristwatch is completed.

Normally, the switch device 4 on the three o'clock side of the first wristwatch case 1 of this wristwatch is in a state where the operation member 15 has been pressed toward the inside of the housing 12 and its position has been restricted to the first slide position by the slide restriction mechanism 16. When the switch device 4 is to be set to this state, first, the engaging section 22 of the stopper member 21 arranged in the engaging groove 20 of the operation member 15 is moved toward the inside of the housing 12 together with the operation member 15.

Here, along with the movement of the engaging section 22, the stopper member 21 is rotated around the fixing shaft 25 in the clockwise direction in FIG. 3. By this rotation of the stopper member 21, the restriction projection 21*b* of the stopper member 21 is caught by one of the plurality of restriction recess sections of the position restriction member (not shown). As a result, the rotation position of the stopper member 21 is restricted and the position of the operation member 15 is restricted to the first slide position.

In this state, the switches of the switch device 4 not shown in the drawings are in their off states where they are not turned on. Accordingly, even when the winder 18 of the operation member 15 is rotated and the shaft section 17 is rotated thereby, the timepiece module 10 is not driven although the cam cylinder (not shown) is rotated together with the spline section 17*b* of the shaft section 17 so as to cause the switch plates (not shown) to perform switch operations along with this rotation. Therefore, operations such as time correction are not performed.

When the timepiece module 10 is to be driven by this switch device 4 so as to perform an operation such as time correction, the winder 18 of the operation member 15 is pulled toward the outside of the first wristwatch case 1. As a result, the shaft section 17 of the operation member 15 is slid, and the engaging section 22 of the stopper member 21 arranged in the engaging groove 20 of the operation member 15 is moved toward the outside of the housing 12 together with the operation member 15. Along with this movement of the engaging section 22, the stopper member 21 is rotated around the fixing shaft 25 in the counterclockwise direction in FIG. 3.

As a result, the restriction projection 21*b* of the stopper member 21 is released from one of the restriction recess sections of the position restriction member where the restriction projection 21*b* has been caught, and is caught by another restriction recess section, whereby the rotation position of the stopper member 21 is restricted and the position of the operation member 15 is restricted to the second slide position. Here, a switch (not shown) of the switch device 4 is turned on and the current mode is switched to a time correction mode where the timepiece module 10 can be driven.

In this state, when the winder 18 of the operation member 15 is rotated, the shaft section 17 of the operation member 15 is rotated along with the rotation of the winder 18, and the cam cylinder (not shown) is rotated along with the rotation of the spline section 17*b* of the shaft section 17. By this rotation of the cam cylinder, the plurality of switch plates (not shown) perform switch operations and, based on switch signals generated thereby, the timepiece module 10 performs an operation such as time correction in the selected mode.

Also, when the operation member 15 is to be pulled out of the stem insertion hole 14 of the housing 12 for maintenance purpose or the like, first, the operation member 15 is pressed toward the inside of the housing 12 so that its position is restricted to the first slide position. In this state, the upper case 6 of the first wristwatch case 1 is detached from the main body case 5, whereby the timepiece module 10 in the main body case 5 is exposed upward, as shown in FIG. 6.

Here, the dial plate 13 provided on the upper surface of the housing 12 is exposed upward, and the pressing operation section 34 of the release lever 31 is exposed upward through the opening section 13*a* provided in the dial plate 13. In this state, a pressing operation is performed on the pressing operation section 34 by use of the first tool 36 such as a pin component. Here, when the leading end of the first tool 36 is inserted into the opening section 13*a* of the dial plate 13 and brought into contact with the concave section 34*a* of the pressing operation section 34, the position of this leading end of the first tool 36 is restricted.

In this state, when the pressing operation section 34 is pressed with the first tool 36, the lever main body 33 of the release lever 31 is flexurally deformed, whereby the release section 35 of the release lever 31 is pressed down. Here, the contact section 35*a* of the release section 35 presses down the projection section 30 on the leading end of the engaging section 22 of the stopper member 21 through the opening 12*a* in the housing 12.

As a result, the stopper member 21 is tilted with the fixing shaft 25 as a fulcrum, whereby the engaging section 22 is downwardly released from the engaging groove 20 of the operation member 15. In this state, the operation member 15 is pulled out of the first wristwatch case 1, whereby the timepiece module 10 can be taken out from the main body case 5.

Next, the assembly of the wristwatch having the second wristwatch case 2 is described.

In this case, first, the parting member 8 is inserted from above into the upper opening of the second wristwatch case 2 and arranged therein. In addition, the watch glass 7 is fitted into the upper opening. In this state, the timepiece module 10 is housed into the second wristwatch case 2 from below. In the case of this timepiece module 10, the release lever 31 which is the second pressing section on the upper surface of the housing 12 is not required to be provided, and therefore no release lever 31 is present.

When the timepiece module 10 is to be housed in the second wristwatch case 2, the stem insertion hole 14 of the housing 12 is coaxially positioned with the through hole 2*a* of the second wristwatch case 2. In this state, the shaft section 17 of the operation member 15 is inserted into the through hole 2*a* of the second wristwatch case 2 from outside the second wristwatch case 2, and then further inserted into the stem insertion hole 14 of the housing 12.

Here, the engaging section 22 of the stopper member 21 has been arranged in the stem insertion hole 14. However, by the inclined guide section 17*d* being provided on the inner end of the shaft main body 17*c* of the shaft section 17, the engaging section 22 is pressed downward along the inclination of the inclined guide section 17*d*. This engaging section 22 surmounts the inclined guide section 17*d* and engages with the engaging groove 20 of the shaft main body 17*c*.

As a result, when the stopper member 21 is rotated along with a pulling operation performed on the operation member 15, the position of the restriction projection 21*b* of the stopper member 21 is restricted by the position restriction member (not shown). Accordingly, the rotation of the stopper member 21 is restricted and the slide position of the operation member 15 is restricted. In this state, when the back cover 37 is attached to the lower part of the second wristwatch case 2, the assembly of the wristwatch is completed.

Normally, this switch device 4 on the three o'clock side of the second wristwatch case 2 of the wristwatch operates in the same manner as when it is in the first wristwatch case 1. When the operation member 15 of this switch device 4 in the second wristwatch case 2 is to be detached, first, the back cover 37 is detached from the lower part of the second wristwatch case 2. As a result, the undersurface side of the timepiece module 10 is exposed on the lower side of the second wristwatch case 2.

Here, the undersurface of the housing 12 of the timepiece module 10 and the projection section 30 of the engaging section 22 serving as the first pressing section are exposed on the lower side of the second wristwatch case 2. In this state, the second tool 38 such as an L-shaped member is inserted from below into the opening 12*a* of the housing 12, and hooked on the projection section 30 of the engaging section 22 so as to pull the projection section 30 downward.

When the projection section 30 is pulled downward as described above, the stopper member 21 is tilted with the fixing shaft 25 as a fulcrum. By this structure, the engaging section 22 can be released from the engaging groove 20 of the operation member 15 and the shaft section 17 of the operation member 15 with the winder 18 can be pulled out of the second wristwatch case 2 without the release lever 31.

As described above, the switch device 4 of the present embodiment includes the release member 24 which releases the engaging section 22 of the stopper member 21 from the engaging groove 20 of the operation member 15 slidably and rotatably inserted into the stem insertion hole 14 of the housing 12 serving as a base member. This release member 24 includes the projection section 30 serving as the first pressing section which is operated from the lower surface side of the housing 12 and thereby releases the engaging section 22 from the engaging groove 20, and the release lever 31 serving as the second pressing section which is operated from the upper surface side of the housing 12 and thereby releases the engaging section 22 from the engaging groove 20. As a result of this structure, this switch device 4 does not impose any constraint on timepiece cases, or in other words, this switch device 4 is highly versatile.

That is, in the case where the operation member 15 is detached from the housing 12 when the switch device 4 is being used with the second wristwatch case 2, the projection section 30 of the release member 24 is operated from the lower surface side of the housing 12, whereby the engaging section 22 of the stopper member 21 is released from the engaging groove 20 of the operation member 15. Also, when the switch device 4 is being used with the first wristwatch case 1, the release lever 31 of the release member 24 is operated from the upper surface side of the housing 12, whereby the engaging section 22 of the stopper member 21 is released from the engaging groove 20 of the operation member 15.

As a result of this structure, the first and second wristwatch cases 1 and 2 which are of different types are not subject to the constraints of the switch device 4. In addition, the switch device 4 can be shared between these first and second wristwatch cases 1 and 2. That is, this switch device 4 is highly versatile.

In the switch device 4 of the present embodiment, the projection section 30 serving as the first pressing section is provided on the leading end of the engaging section 22 of the stopper member 21 and exposed on the lower surface side of the housing 12, and the release lever 31 serving as the second pressing section is arranged and exposed on the upper surface side of housing 12. By this structure, the projection section 30 can be operated from the lower surface side of the housing 12, and the release lever 31 can be operated from the upper surface side of the housing 12. In other words, an operation of releasing the engaging section 22 from the engaging groove 20 can be performed from either side of the housing 12, that is, the upper surface side or the lower surface side.

Also, in this switch device, the release lever 31 is a plate spring that is flexurally deformed toward the stopper member 21, and includes the pressing operation section 34 which is subjected to a pressing operation performed from the upper surface side of the housing 12, and the release section 35 which presses down the projection section 30 of the engaging section 22 in response to the pressing operation performed on the pressing operation section 34 so as to release the engaging section 22 from the engaging groove 20. Accordingly, only by the pressing operation section 34 being pressed from above the housing 12, the release lever 31 is flexurally deformed toward the stopper member 21, and the release section 35 presses the projection section 30 of the engaging section 22 by this flexural deformation. As a result, the engaging section 22 is easily and favorably released from the engaging groove 20.

In the switch device 4 of the present embodiment, the pressing operation section 34 of the release lever 31 is arranged in the outer circumferential portion of the housing 12 near the operation member 15 and exposed on the upper surface side of the housing 12. Accordingly, the pressing operation section 34 can be unfailingly and favorably pressed from above the housing 12. In addition, in the central portion of the pressing operation section 34, the concave section 34*a* is provided. Therefore, when a pressing operation is to be performed on the pressing operation section 34 with the first tool 36 such as a pin component, the position of the leading end of the first tool 36 is restricted by the concave section 34*a*, whereby the pressing operation section 34 can be unfailingly and favorably pressed.

Also, this wristwatch includes the first wristwatch case 1 which houses the switch device 4. This first wristwatch case 1 includes the main body case 5 that is the first case whose upper surface side, that is, front surface side is open and lower surface side, that is, back surface side is sealed, and the upper case 6 that is the second case to which the watch glass 7 is attached and which is attached to the upper surface side of the main body case 5. As a result of this structure, by the upper case 6 being detached from the main body case 5, the release lever 31 can be operated from above the main body case 5 with the switch device 4 and the housing 12 being arranged in the main body case 5, whereby the engaging section 22 of the stopper member 21 can be favorably released from the engaging groove 20 of the operation member 15.

Alternatively, this wristwatch includes the second wristwatch case 2 which also houses the switch device 4. On the upper surface side of this second wristwatch case 2, that is, on the front surface side thereof, the watch glass 7 is provided. To the lower surface side of this second wristwatch case 2, that is, to the back surface side thereof, the back cover 37 is attached. As a result of this structure, by the back cover 37 being detached, the projection section 30 provided on the leading end of the engaging section 22 can be operated from below the second wristwatch case 2 with the switch device 4 and the housing 12 being arranged in the second wristwatch case 2, whereby the engaging section 22 of the stopper member 21 can be favorably released from the engaging groove 20 of the operation member 15.

In the above-described embodiment, the switch device 4 on the three o'clock side of the first or second wristwatch case 1 or 2 has been described. However, the present invention is not limited thereto, and can be applied to the switch devices 4 on the two o'clock side and the four o'clock side.

Figure 9:
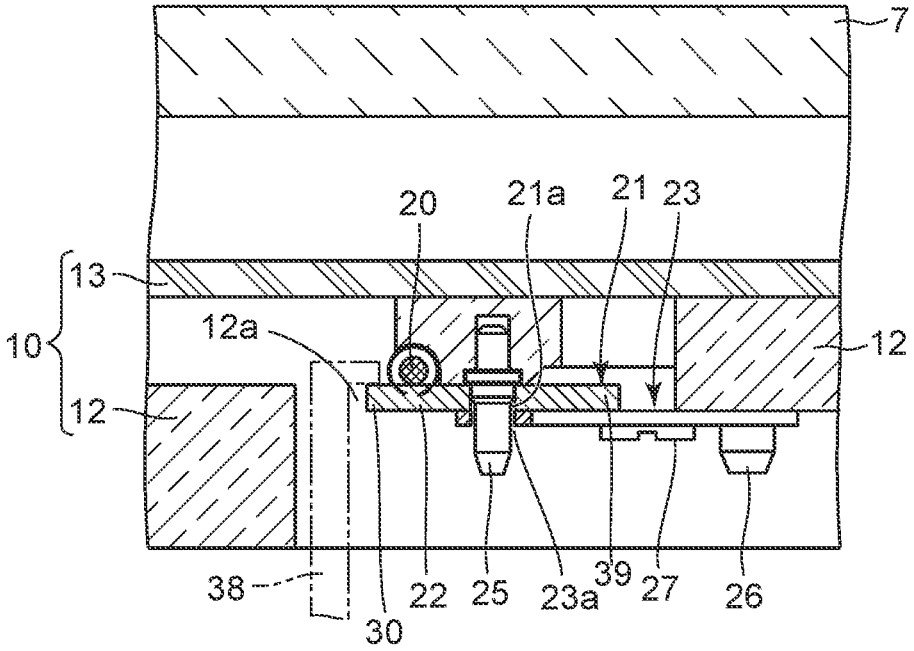
FIG. 9 is an enlarged cross-sectional view showing the main portion of the switch device taken along the E-E arrow view shown in FIG. 8.

Also, in the above-described embodiment, when the operation member 15 of the switch device 4 is to be detached from the second wristwatch case 2, the second tool 38 such as an L-shaped member is inserted from below and pulls down the projection section 30 of the engaging section 22 so as to release the engaging section 22 from the engaging groove 20 of the operation member 15, as shown in FIG. 9 and FIG. 10. However, the present invention is not limited thereto. For example, a structure may be adopted in which the projection section 39 of the stopper member 21 is pressed upward by the first tool 36 such as a pin component and thereby releases the engaging section 22 from the engaging groove 20 of the operation member 15.

In that structure as well, when the projection section 39 of the stopper member 21 is pressed upward, the stopper member 21 is tilted with the fixing shaft 25 as a fulcrum. Accordingly, the engaging section 22 can be released from the engaging groove 20 of the operation member 15 and the shaft section 17 of the operation member 15 with the winder 18 can be pulled out of the second wristwatch case 2 without the release lever 31.

Moreover, in the above-described embodiment, the present invention has been applied in a wristwatch. However, the present invention is not necessarily required to be applied in a wristwatch. For example, the present invention is applicable to various types of timepieces such as a travel watch, an alarm clock, a table clock, and a wall clock. In addition, the present invention is not necessarily required to be applied in timepieces, and is applicable to electronic devices such as a portable phone and a portable terminal.

While the present invention has been described with reference to the preferred embodiments, it is intended that the invention be not limited by any of the details of the description therein but includes all the embodiments which fall within the scope of the appended claims.

What is claimed is:

1. A switch device comprising:

a base member provided with a stem insertion hole;

an operation member which has an engaging groove provided in an outer circumferential surface thereof, and is slidably and rotatably inserted into the stem insertion hole of the base member;

a stopper member having an engaging portion which is arranged in the engaging groove of the operation member and moved along with sliding of the operation member; and a release member which releases the engaging portion from the engaging groove, wherein the release member includes a pressing portion which is operated from one surface side of the base member so as to release the engaging portion from the engaging groove, and wherein the pressing portion is a plate spring that is arranged to be exposed on the one surface side of the base member and that is flexurally deformed toward the stopper member, and includes a pressing operation portion which is subjected to a pressing operation performed from the one surface side of the base member, and a release portion which releases the engaging portion from the engaging groove by pressing a projection of the engaging portion in response to the pressing operation performed on the pressing operation portion.

2. The switch device according to claim 1, wherein the pressing portion is a release lever.

3. The switch device according to claim 1, wherein the pressing operation portion of the release lever is arranged in an outer circumferential portion of the base member near the operation member, and exposed on the one surface side of the base member.

4. The switch device according to claim 1, wherein the one surface of the base member is a front surface of the base member.

5. A timepiece comprising: the switch device according to claim 1, and a case which houses the switch device.

6. The timepiece according to claim 5, wherein the case includes a first case whose front surface side is open and back surface side is sealed, and a second case which is provided with a timepiece glass and attached to the front surface side of the first case.

7. The timepiece according to claim 5, wherein the case has a timepiece glass provided on a front surface side and a back cover attached to a back surface side.

8. A timepiece comprising:

a base member provided with a stem insertion hole;

an operation member which has an engaging groove provided in an outer circumferential surface thereof, and is slidably and rotatably inserted into the stem insertion hole of the base member;

a stopper member having an engaging portion which is arranged in the engaging groove of the operation member and moved along with sliding of the operation member;

a release member which releases the engaging portion from the engaging groove; and a dial plate arranged on the one surface side of the base member, wherein an opening section for exposing at least a portion of the release member on the one surface side is formed on the dial plate.

9. The timepiece according to claim 8, wherein the release member includes a pressing portion which is operated from one surface side of the base member so as to release the engaging portion from the engaging groove, and wherein the opening section formed on the dial plate is formed for exposing at least a portion of the pressing portion of the release member on the one surface side.

10. The timepiece according to claim 8, wherein the pressing portion is a release lever provided on the one surface of the base member, and is arranged to be exposed on the one surface side of the base member.

11. The timepiece according to claim 10, wherein the release lever is a plate spring that is flexurally deformed toward the stopper member, and includes a pressing operation portion which is subjected to a pressing operation performed from the one surface side of the base member, and a release portion which releases the engaging portion from the engaging groove by pressing a projection of the engaging portion in response to the pressing operation performed on the pressing operation portion.

12. The timepiece according to claim 11, wherein the pressing operation portion of the release lever is arranged in an outer circumferential portion of the base member near the operation member, and exposed on the one surface side of the base member.

13. The timepiece according to claim 8, wherein the one surface of the base member is a front surface of the base member.

14. The timepiece according to claim 8, comprising a case which houses the base member, the operation member, the stopper member, the release member, and the dial plate.

15. The timepiece according to claim 14, wherein the case includes a first case whose front surface side is open and back surface side is sealed, and a second case which is provided with a timepiece glass and attached to the front surface side of the first case.

16. The timepiece according to claim 14, wherein the case has a timepiece glass provided on a front surface side and a back cover attached to a back surface side.

17. The timepiece according to claim 15, wherein a parting member is provided on inner portions of the second case, and wherein the opening section formed on the dial plate is provided corresponding to a portion of the parting member.

* * * * *